US005699936A

United States Patent [19]

Sakamoto

[11] Patent Number: 5,699,936

[45] Date of Patent: Dec. 23, 1997

[54] LIQUID DISPENSING SYSTEM

[75] Inventor: Masahiko Sakamoto, Diamond Bar, Calif.

[73] Assignee: Sercomp Corporation, Chatsworth, Calif.

[21] Appl. No.: 525,283

[22] Filed: Sep. 8, 1995

[51] Int. Cl.[6] ..... B65D 35/08

[52] U.S. Cl. ..... 222/107; 222/464.1; 222/541.6

[58] Field of Search ..... 222/92, 105, 106, 222/107, 153.06, 464.1, 541.6; 604/244, 408, 414

[56] References Cited

U.S. PATENT DOCUMENTS

| | | | |
|---|---|---|---|
| 2,420,223 | 5/1947 | Brewer | 222/541.6 |
| 2,577,045 | 12/1951 | Stout . | |
| 2,929,378 | 3/1960 | Grosclaude | 604/244 |
| 3,171,412 | 3/1965 | Braun | 604/244 |
| 3,364,930 | 1/1968 | Ryan . | |
| 3,482,572 | 12/1969 | Grosclaude et al. | 222/541.6 |
| 3,764,796 | 10/1973 | Gilliam et al. . | |
| 4,119,128 | 10/1978 | Bishop . | |
| 4,183,684 | 1/1980 | Avery, Jr. . | |
| 4,408,700 | 10/1983 | Fillmore et al. | 222/153.06 |
| 4,435,179 | 3/1984 | Walker | 604/410 |
| 4,528,268 | 7/1985 | Andersen et al. . | |
| 5,152,432 | 10/1992 | DeLaforcade . | |
| 5,222,530 | 6/1993 | Baker et al. . | |
| 5,288,159 | 2/1994 | Wirt . | |

FOREIGN PATENT DOCUMENTS

| | | | |
|---|---|---|---|
| 574820 | 1/1946 | United Kingdom | 222/541.6 |

*Primary Examiner*—Philippe Derakshani
*Attorney, Agent, or Firm*—Koda & Androlia

[57] ABSTRACT

A liquid container/dispenser including a container body defining a flexible wall for storing a liquid and a tube member having a first end portion placed outside the container body and a second closed end portion placed inside the container body. The tube member has an opening device provided in the second closed end portion of the tube member inside the container body. The second closed end portion can be broken off from the rest of the tube member inside the container body by a force applied through the wall of the container body. The wall of the container body is preferably made from a flexible material so that the wall can be flexibly brought into contact with the tube member inside the container. The liquid container with the novel dispensing system assures the sealed storage of liquid in the container and yet facilitates clean, quick and safe dispensing of the liquid.

12 Claims, 5 Drawing Sheets

LIQUID DISPENSING SYSTEM

BACKGROUND OF THE INVENTION

1. Field of the Invention

This invention relates to a liquid container/dispenser for dispensing liquid, such as beverage, oil, paint and ink. More particularly, the present invention relates to a liquid container having a novel dispensing system that assures the sealed storage of liquid in the container and yet facilitates clean, quick and safe dispensing of the liquid.

2. Prior Art

A variety of liquid dispensers have been used for storing liquid in a sealed container and allowing a user to dispense the liquid from the sealed container. For example, a disposable ink cartridge stores a liquid ink in a sealed container and has a coupler for allowing liquid communication from the sealed container to an ink jet apparatus. Typically, a seal is applied on the coupler portion to contain the liquid ink inside the container when the ink cartridge is stored, and the seal is removed just before the ink cartridge is mounted on the ink jet apparatus. Although the ink cartridge is mounted on the ink jet apparatus relatively immediately after the seal is removed from the coupler portion, there are always risks of spills of liquid ink from the opened coupler portion and thus contamination of, for example, the user's hands, clothes or exposed portions of the ink jet apparatus.

In other liquid dispensers, a liquid is contained in a rupturable container. For example, U.S. Pat. No. 5,288,159 issued to Wirt describes a liquid applicator that has a rupturable container slidably stored in a cylindrical handle. The rupturable container of Wirt is formed from a liquid containing ampoule that has a rupturable neck portion. The cylindrical tube has a slanted step-wise interior configuration that is engageable with a portion of the rupturable neck portion of the rupturable container. Sliding the rupturable container through the cylindrical handle brings the rupturable neck portion in contact with the slanted step-wise interior configuration. The rupturable neck portion breaks off when the rupturable container is pushed hard against the slanted step-wise interior configuration. The cylindrical handle has a relatively complex interior structure to allow the rupturable container to slide through the cylindrical handle and secure the engagement between the rupturable neck portion of the reservoir container and the slanted step-wise configuration.

SUMMARY OF THE INVENTION

It is an object of an embodiment of the present invention to provide a liquid container having a novel dispensing system that assures the sealed storage of liquid in the container and yet facilitates clean, quick and safe dispensing of the liquid with a relatively simple mechanical structure.

It is another object of an embodiment of the present invention to provide a liquid container/dispenser including a container body defining a flexible wall for storing a liquid and a tube member having a first end portion placed outside the container body and a second closed end portion placed inside the container body. The tube member has an opening device provided in the second closed end portion of the tube member inside the container body. The second closed end portion can be broken off from the rest of the tube member inside the container body by a force applied through the wall of the container body. In a preferred embodiment, the wall of the container body is made from a flexible material so that the wall can be flexibly brought into contact with the tube member inside the container.

In accordance with a preferred embodiment, the opening device is a snap-off score formed in the tube member adjacent the second closed end portion hereof. When the closed end portion of the tube member is snapped off at the snap-off score, the liquid contained in the container body can communicate with the first end portion that is located outside the container body.

In accordance with a preferred embodiment of the present invention, a liquid container/dispenser includes a container body having a top portion defining an aperture for sealingly coupling the tube member and a bottom portion opposite the top portion. The bottom portion of the container has a volume sufficient to store a substantially entire portion of the liquid within the container body and the top portion of the container body has a thickness substantially thinner than that of the bottom portion. The closed end portion of the tube member may be located adjacent the top portion of the container body in such a bottom thick/top thin configuration of the container body. The liquid contained in the container body may be moved into the bottom portion thereof by, for example, holding the container relatively upright. The thin wall portion adjacent the top portion of the container body facilitates bending of the top portion of the container body and the tube member within the container body.

In accordance with a preferred embodiment of the present invention, a tube member has a portion inside the container body that extends to the bottom portion of the container body so that the closed end portion of the tube member is placed adjacent the bottom portion of the container body. In a preferred embodiment, the tube member extends across substantially the entire height of the container body so that the snap-off score is located adjacent the bottom of the container body. Further, in accordance with a preferred embodiment of the present invention, the container body has a top portion and a bottom portion opposite the top portion in which the bottom portion of the container body has a thickness substantially thinner than that of the top portion of the container body to facilitate bending of the wall of the container body in the bottom portion thereof. The elongated portion of the tube member extends into the thin bottom portion of the container body so that the closed end portion of the tube member is placed adjacent the bottom of the container body. The liquid contained in the container body may be moved into the top portion thereof by, for example, holding the container upside down. The thin bottom portion of the container body facilitates bending of the bottom portion of the container body and the tube member within the container body. After the closed end portion is broken off within the container body, the container body is turned to the upright position for dispensing the liquid from the container body.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Figure 1:
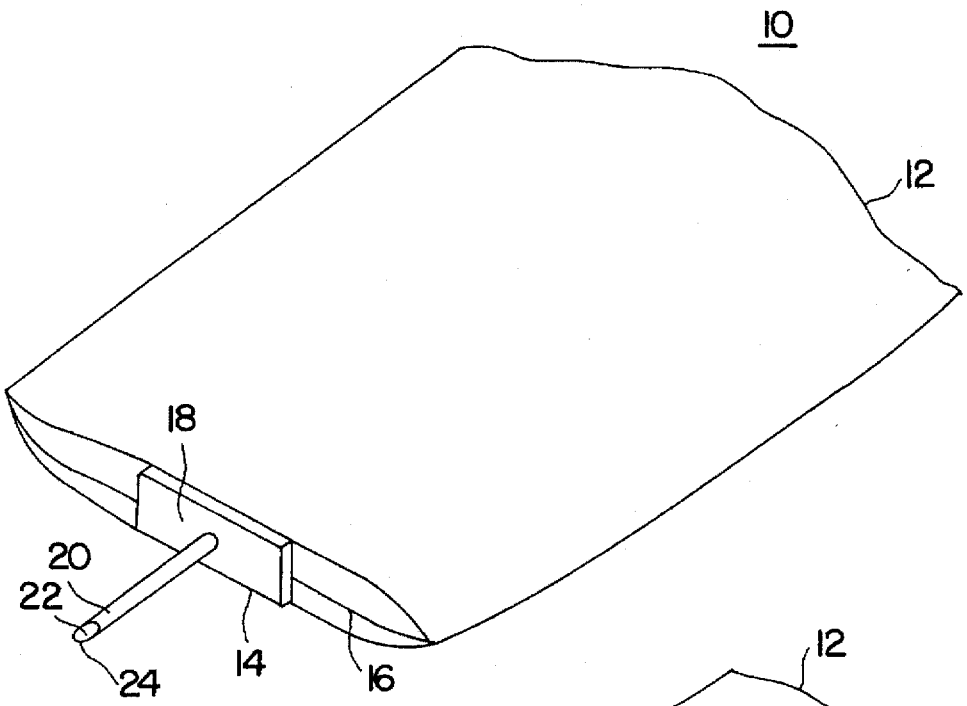
FIG. 1 is a perspective view of a container-dispenser in accordance with an embodiment of the present invention.

Embodiments in accordance with the present invention are described below with reference to the accompanying drawings.

A container-dispenser in accordance with an embodiment of the present invention is generally indicated at numeral 10. The container-dispenser 10 includes a container body 12 and a dispenser system 14. The container body 12 comprises a bag which is preferably made of a flexible material, such as a polymeric material, a synthetic rubber material, and paper so that the container body can be bent, twisted or folded. The dispenser system 14 is sealingly connected to the container body 12 at a top end portion 16 thereof. The dispenser system 14 may be made of a polymeric material and connected to the container body 12 by means of heat bonding or adhesive. In accordance with a preferred embodiment, the dispenser system 14 has a flange 18 to facilitate connection between the dispenser system 14 and the container body 12 by means of heat bonding or adhesive. The dispenser system 14 also includes an external tube member 20 defining an aperture 22. In accordance with another embodiment, a distal end portion 24 of the external tube member 20 may be closed or capped when the container-dispenser 10 is stored and may be opened to provide the aperture 22 at the distal end portion when the liquid is dispensed.

Figure 2:
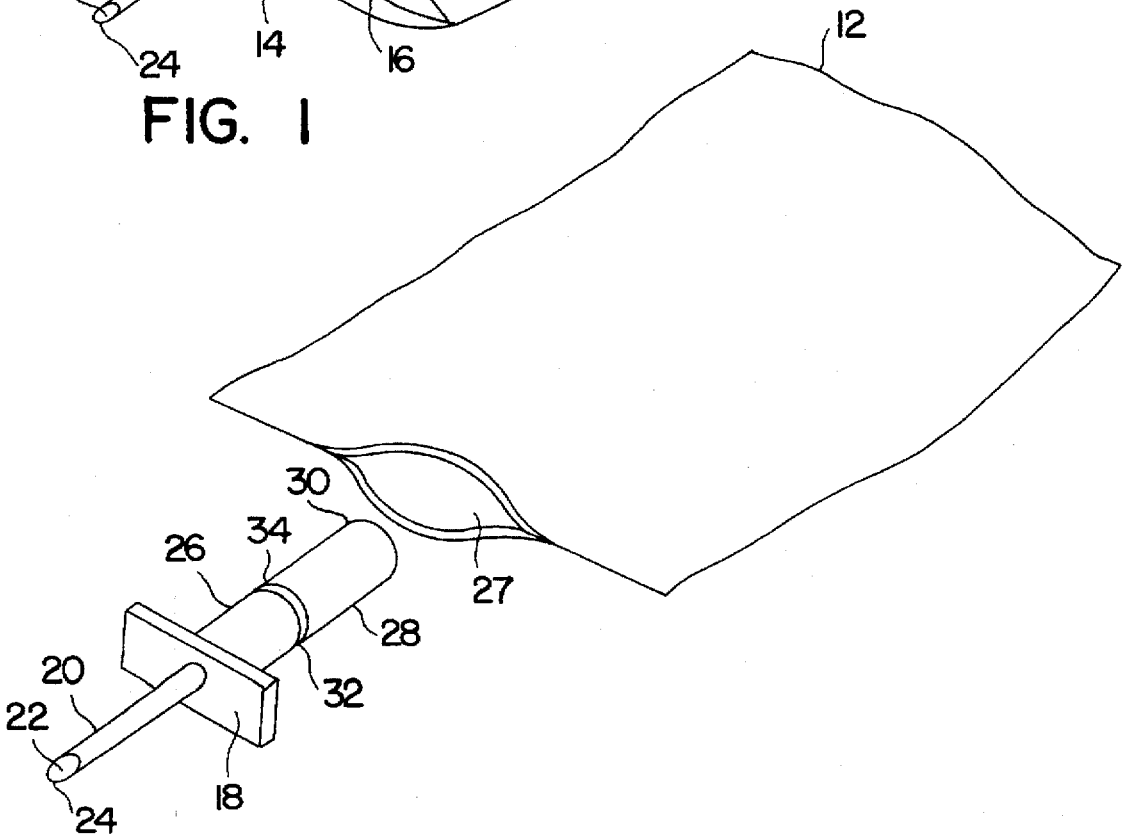
FIG. 2 is an exploded perspective view of a container-dispenser in accordance with an embodiment of the present invention.
Figure 3:
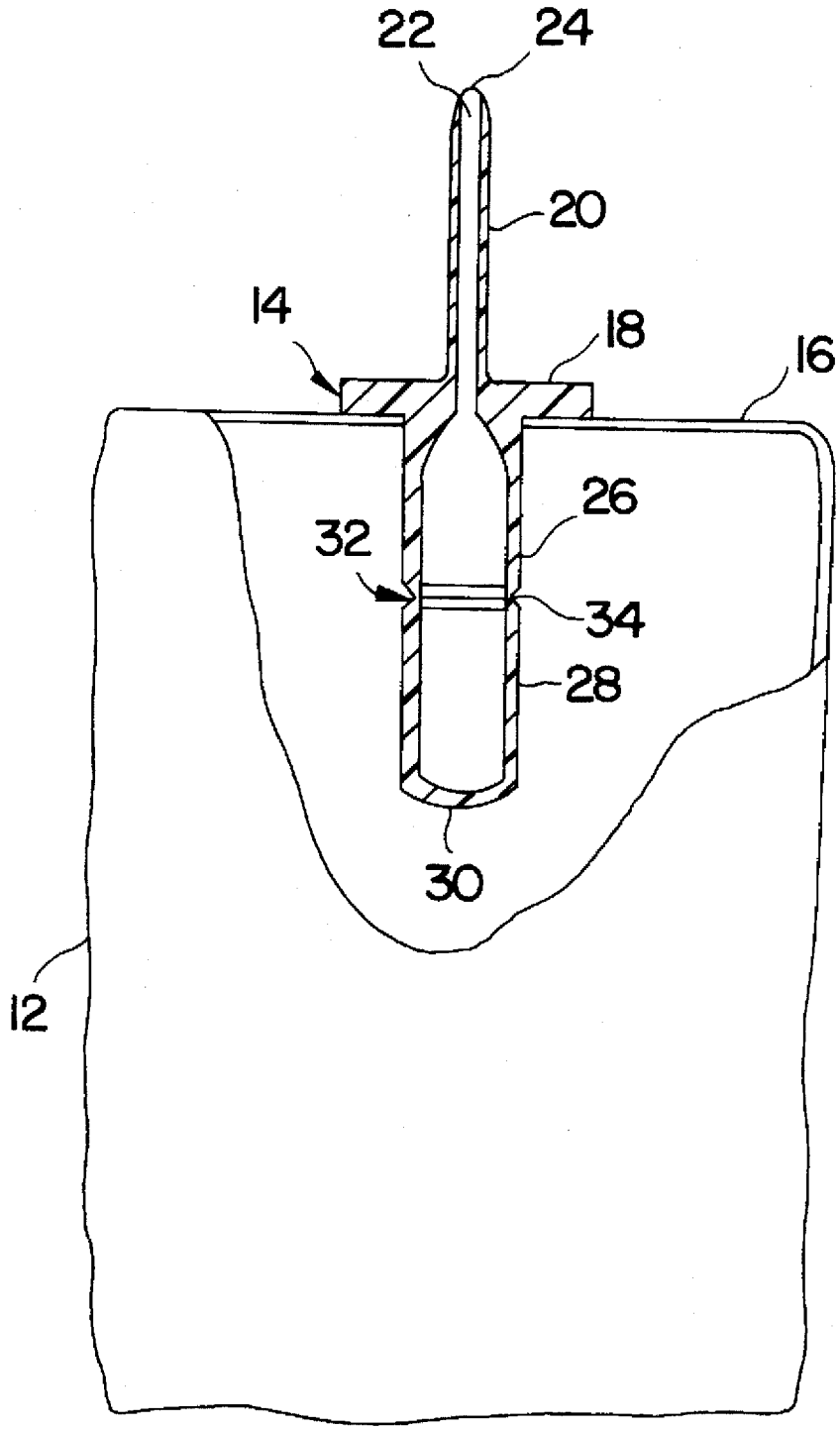
FIG. 3 is a partially broken front view of the container-dispenser shown in FIG. 1 in which a tube member assembly is attached to a container.
Figure 4:
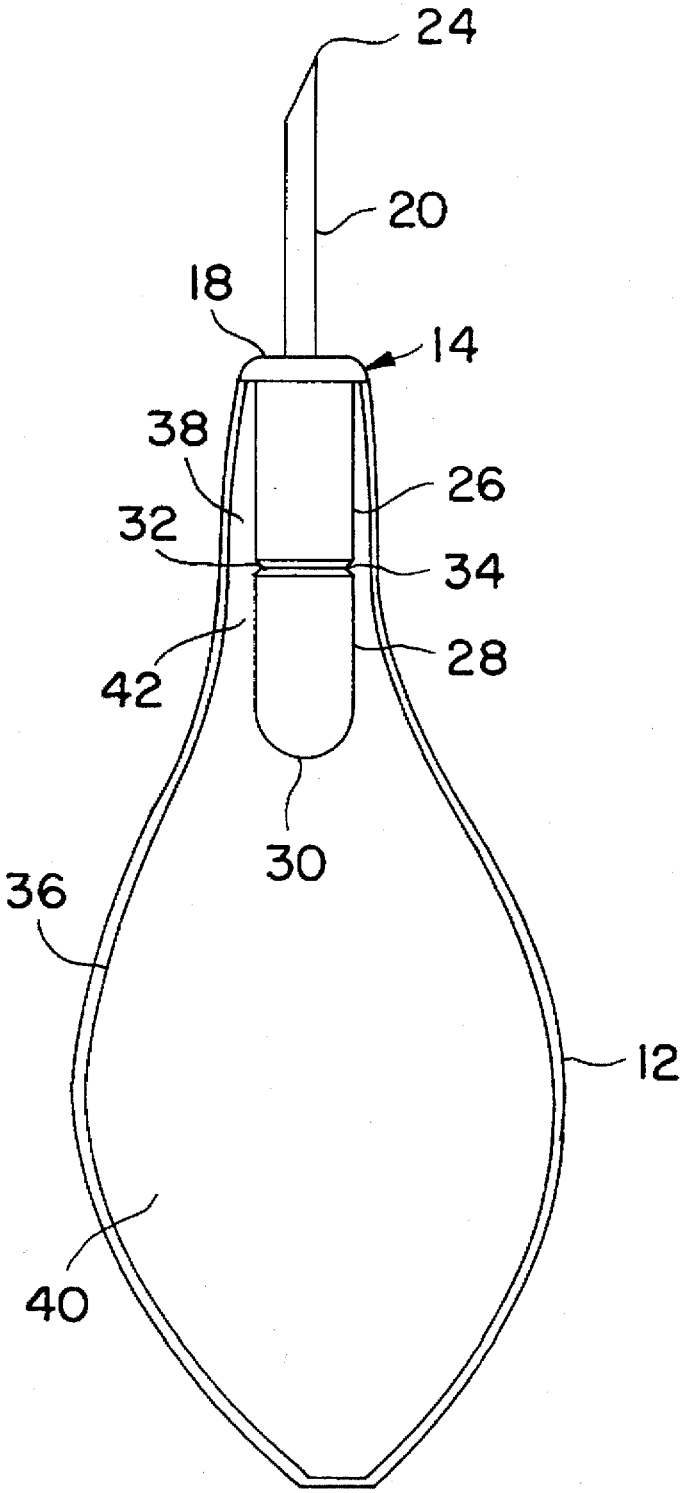
FIG. 4 is a cross-sectional side view of a container-dispenser shown in FIG. 3.

As shown in FIGS. 2 and 3, the dispenser system 14 includes an internal tube member 26 that is placed inside the container body 12. The internal tube member 26 is inserted in the container body 12 through an aperture 27 provided at the top end portion 16 of the container body 12. The internal tube member 26 has a closed end portion 28 adjacent a proximal end 30 of the internal tube member 26. The closed end portion 28 is designed to be broken off or torn off from the rest of the internal tube member 26. In accordance with a preferred embodiment of the present invention, the closed end portion 28 has an opening device 32 that may be broken off or torn off by a bending force or a twisting force applied through the bag-like container body 12. In accordance with an embodiment of the present invention, a snap-off score 34 is provided between the closed end portion 28 and the rest of the internal tube member 26 so that the snap-off score 34 is broken off when a bending force is applied to the closed end portion 28 with respect to the rest of the internal tube member 26. To facilitate snapping off the closed end portion, the internal member 26 is made of a relatively brittle plastic material or glass.

In the illustrated embodiment, the external tube member 20 and the internal tube member 26 have different diameters, the internal tube member 26 being larger in diameter than the external tube member 20. However, it is appreciated that the external tube member 20 and the internal tube member may have the same diameter depending upon the requirements. Also in the illustrated embodiment, the external tube member 20 and the internal tube member 26 are integrally formed in a unit. However, the external tube member 20 may be formed separately of the internal tube member 26, and these external tube member 20 and the internal tube member 26 may be connected by means of heat-bonding or adhesive.

In accordance with one feature of embodiments of the present invention, the closed end portion 28 may be broken off or torn off by a bending force or a twisting force applied through the bag-like container body 12. However, the liquid contained within the container body 12 may interfere with the bending or twisting of the container body 12 if the liquid fills gaps 38 between the wall 36 and the internal tube member 26 to an extent that the gaps substantially separate the wall 36 from the internal tube member 26. In order to facilitate bending or twisting of the closed end portion 28 through a wall 36 of the bag-like container body 12, the wall 36 of the bag-like container body 12 is preferably allowed to come in contact with the closed end portion 28 and the internal tube member 26. In accordance with an embodiment of the present invention, the container body 12 has a relatively thick bottom section 40 that has a storage capacity for storing a substantial part of the liquid within the container body 12 and a relatively thin top section 42 adjacent the internal tube member 26 and the closed end portion 28. When the container-dispenser 10 is held substantially upright, the substantial part of the liquid within the container body 12 moves into the relatively thick bottom section 40. As a result, the relatively thin top section is substantially emptied. Accordingly, the wall 36 is readily brought into contact with the internal tube member 26.

Figure 5:
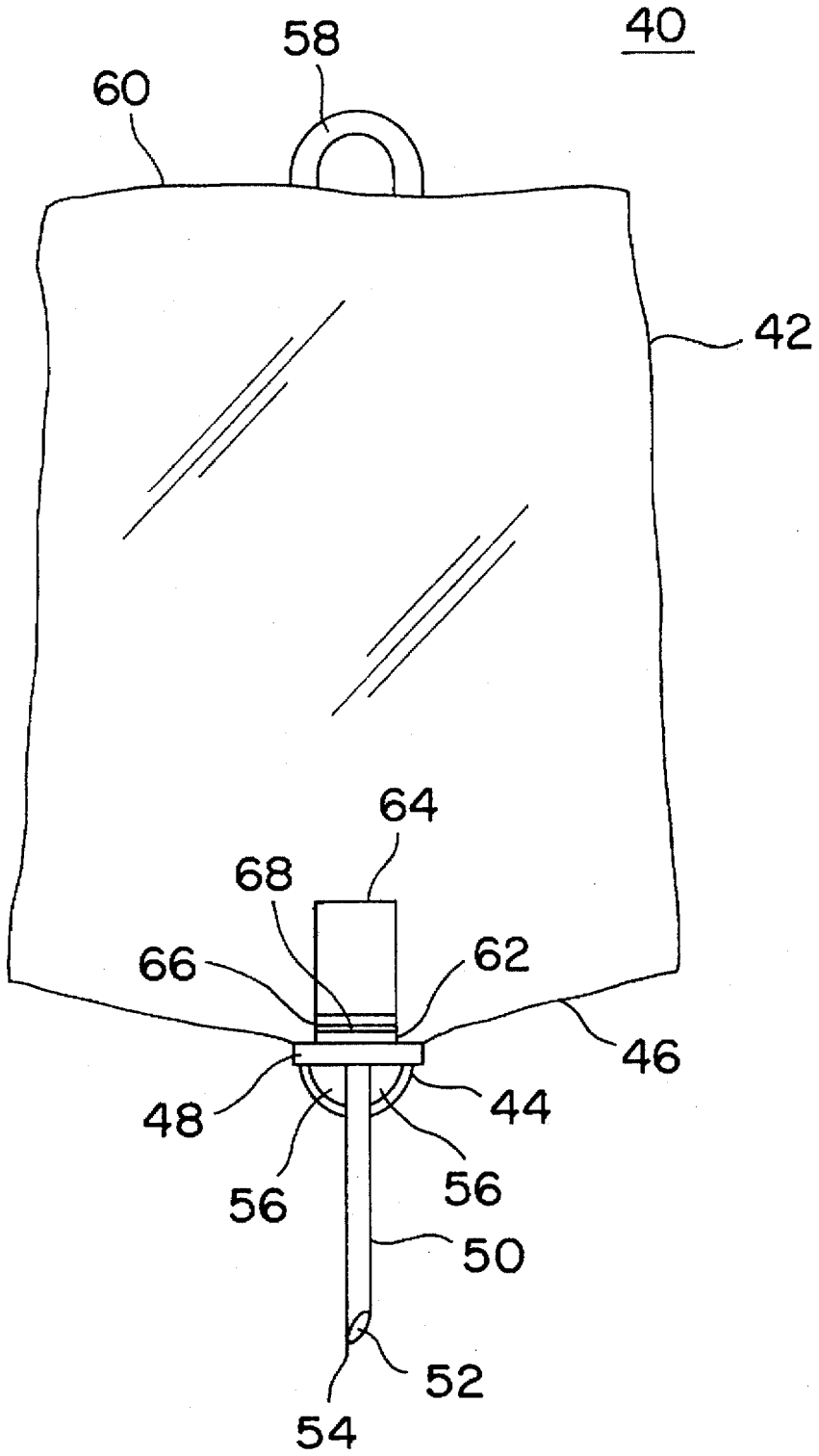
FIG. 5 is a front view of a container-dispenser in accordance with an embodiment of the present invention.

A container-dispenser in accordance with another embodiment of the present invention is generally indicated at numeral 40 as shown in FIG. 5. The container-dispenser 40 includes a container body 42 and a dispenser system 44. The container body 42 comprises a bag which is preferably made of a flexible material, such as a polymeric material, a synthetic rubber material, and paper or made from a laminated material including layers of metal foil, polymeric material, paper or the like so that the container body can be bent, twisted or folded. In the illustrated embodiment, the bag-like container body 42 is formed from a transparent polymer material. The dispenser system 44 is sealingly connected to the container body 42 at a bottom end portion 46 thereof. The dispenser system 44 is connected to the container body 42 by means of heat bonding or adhesive. In accordance with a preferred embodiment, the dispenser system 44 has a flange 48 to facilitate connection between the dispenser system 44 and the container body 42 by means of heat bonding or adhesive. The dispenser system 44 also includes an external tube member 50 defining an aperture 52. In accordance with another embodiment, a distal end portion 54 of the external tube member 50 may be closed or capped when the container-dispenser 40 is stored and the distal end portion 54 may be opened or uncapped to provide the aperture 52 at the distal end portion so that the liquid can be dispensed. In the illustrated embodiment, tabs 56 are provided between the flange 48 and the external tube member 50 to enforce the external tube member 50. As shown in FIG. 5, the container-dispenser 40 is used with the dispenser system 44 being placed at the bottom of the container body 42. A loop 58 or the like may be attached to a top end portion 60 of the container body 42 for hanging the container-dispenser 40 from a separate support member (not shown).

The dispenser system 44 includes an internal tube member 62 that is placed inside the container body 42. The internal tube member 62 includes a closed end portion 64 of the internal tube member 62.

In accordance with a preferred embodiment of the present invention, the closed end portion 64 has an opening device 66 that may be broken off or torn off by a bending force or a twisting force applied through the bag-like container body 42. In accordance with an embodiment of the present invention, the opening device 66 comprises a snap-off score 68 provided between the closed end portion 64 and the rest of the internal tube member 62 so that the snap-off score 68 is broken off when a bending force is applied to the closed end portion 64 with respect to the rest of the internal tube member 62. To facilitate snapping off the closed end portion, the internal member 62 is made of a relatively brittle plastic material or glass. In the illustrated embodiment as shown in FIG. 5, the snap-off score 68 is provided adjacent the bottom end portion 46 and the flange 48. As a result, when the closed end portion 64 is snapped off within the container body 42, a liquid outlet is formed at the snap-off score 68 adjacent the bottom end 46 of the container body 42. Accordingly, substantially the entire volume of the liquid inside the container body 42 may be dispensed when the container body 42 is hanged by the loop 58. In accordance with a further embodiment of the present invention, the bottom end portion 46 is sloped so that the snap-off score 68 may be located at a lowest possible level along the bottom end portion 46.

Since the snap-off score 68 according to the embodiment shown in FIG. 5 is provided very close to the flange 48, the internal tube member 62 may be too short for the user to hold for snapping off the closed end portion 64. In such a case, the user may hold the tabs 56 and areas around the tabs 56 to snap off the closed end portion 64. The tabs 56 enforce the rigidity of the external tube member 50 and facilitate snapping off the closed end portion 64.

Figure 6:
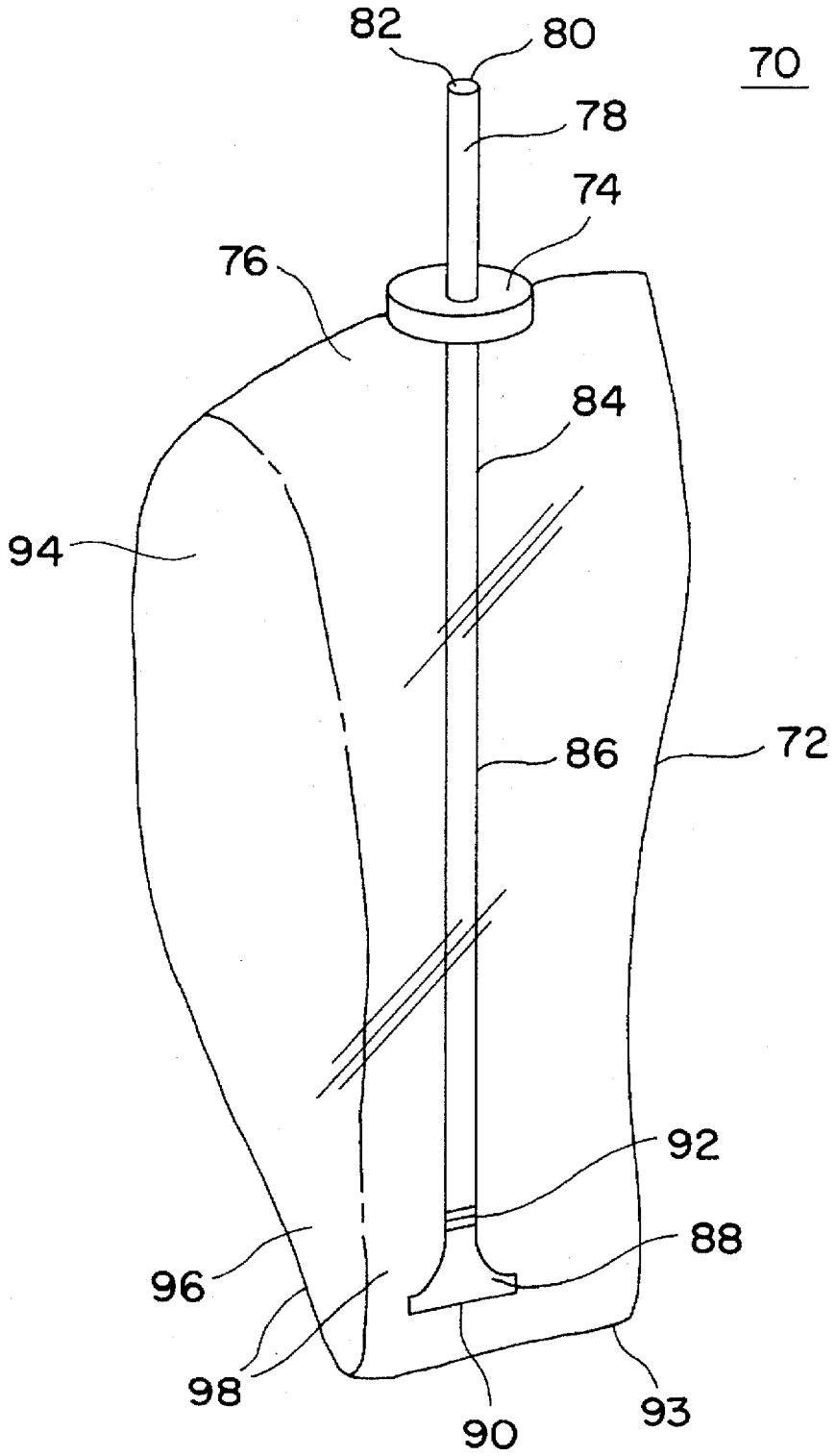
FIG. 6 is a perspective view of a container-dispenser in accordance with an embodiment of the present invention.

FIG. 6 shows another embodiment of the present invention. A container-dispenser 70 in accordance with this embodiment may be used, among other things, as a beverage dispenser for dispensing a beverage stored in a container body 72 through a dispenser system 74. The container body 72 comprises a bag which is preferably made of a flexible material, such as a polymeric material, a synthetic rubber material, and paper or made from a laminated material including layers of metal foil, polymeric material, paper or the like so that the container body can be bent, twisted or folded.

The dispenser system 74 is sealingly connected to the container body 72 at a top end portion 76 thereof. The dispenser system 74 may be made of a polymeric material and connected to the container body 72 by means of heat bonding or adhesive. In accordance with a preferred embodiment, the dispenser system 74 includes an external tube member 78 defining an aperture 80. In accordance with another embodiment, a distal end portion 82 of the external tube member 78 may be closed or capped when the container-dispenser 70 is stored and opened to provide the aperture 80 at the distal end portion when the beverage is dispensed.

The dispenser system 74 includes an internal tube member 84 that is placed inside the container body 72. As shown in FIG. 6, the internal tube member 74 has an extended tube portion 86 that extends across substantially the entire height of the container body 72 and a closed end portion 88 adjacent a proximal end 90 of the extended tube portion 86. In accordance with a preferred embodiment of the present invention, the closed end portion 88 has a snap-off score 92 provided between the closed end portion 88 and the extended tube portion 86 so that the snap-off score 92 is broken off when a bending force or a twisting force is applied to the closed end portion 88. The snap-off score 92 may preferably be provided as close to a bottom end 93 of the container body 72 as possible so that the user can dispense substantially the entire volume of the beverage from the container body 72.

In accordance with an embodiment of the present invention, the container body 72 has a relatively thick top section 94 that has a storage capacity for storing a substantial part of the liquid within the container body 72 and a relatively thin bottom section 96 adjacent the closed end portion 88. When the container-dispenser 70 is held substantially upside down, the substantial part of the liquid within the container body 72 moves into the relatively thick top section 94. As a result, the relatively thin bottom section is substantially emptied. Accordingly, walls 98 adjacent the closed end portion 88 are readily brought into contact with the closed end portion 88. After removing the closed end portion 88, the container-dispenser 70 is held in the upright position for dispensing the beverage from the container body 72.

The presently disclosed embodiments should be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. A liquid dispenser comprising:

a container body for storing a liquid, the container body defining a wall;

a tube member having a first end portion placed outside the container body and a second closed end portion placed inside the container body; and an opening device provided in the second closed end portion of the tube member inside the container body for opening the second closed end portion by a bending force applied through the wall of the container body; and wherein the container body has a top portion defining an aperture for sealingly coupling the tube member and a bottom portion opposite the top portion, wherein the bottom portion of the container has a volume sufficient to store a substantially entire portion of the liquid within the container body and the top portion of the container body has a thickness substantially thinner than that of the bottom portion to facilitate bending of the top portion of the container body and the tube member within the container body.

2. A liquid dispenser according to claim 1, wherein the opening device comprises a snap-off score formed in the tube member adjacent the second closed end portion thereof for snapping off the second closed end portion inside the container body to allow the liquid to communicate with the first end portion.

3. A liquid dispenser according to claim 1, wherein the container body is made from a flexible material for allowing the container body to flexibly deform.

4. A liquid dispenser according to claim 3, wherein the tube member is made from a relatively brittle material to facilitate breaking-off of the second closed end portion of the tube member at the opening device.

5. A liquid dispenser according to claim 2, wherein the container body is made from a pliant material for allowing the container body to flexibly deform and the tube member is made from a relatively hard material to facilitate breaking-off of the second closed end portion of the tube member at the snap-off score when the container body and the tube member inside the container body are bent about the snap-off score.

6. A liquid dispenser according to claim 5, wherein the container body has a top portion defining an aperture for sealingly coupling the tube member and a bottom portion opposite the top portion, wherein the bottom portion of the container has a volume sufficient to store a substantially entire portion of the liquid within the container body and the top portion of the container body is configured to allow the wall of the container body to come in contact with the tube member inside the container body when the substantially entire portion of the liquid is placed in the bottom portion of the container body.

7. A liquid dispenser according to claim 6, wherein the container body has side ends and the top portion has shoulders tapered toward the side ends of the container body to define a highest point between the shoulders wherein the aperture is provided at the highest point and the snap-off score is provided adjacent the aperture.

8. A liquid dispenser according to claim 1, wherein the container body has a top portion defining an aperture for sealingly coupling the tube member and a bottom portion opposite the top portion, and the tube member has a portion inside the container body extending to the bottom portion of the container body so that the closed end portion of the tube member is placed adjacent the bottom portion of the container body.

9. A liquid dispenser according to claim 5, wherein the container body has a top portion defining an aperture for sealingly coupling the tube member and a bottom portion opposite the top portion, wherein the upper portion of the container has a volume sufficient to store a substantially entire portion of the liquid within the container body and the bottom portion of the container body is configured to allow the wall of the container body to come in contact with the tube member inside the container body when the substantially entire portion of the liquid is placed in the upper portion of the container body.

10. A liquid dispenser comprising:

a container body for storing a liquid, the container body defining a wall;

a tube member having a first end portion placed outside the container body and a second closed end portion placed inside the container body; and an opening device provided in the second closed end portion of the tube member inside the container body for opening the second closed end portion by a bending force applied through the wall of the container body; and wherein the opening device comprises a snap-off score formed in the tube member adjacent the second closed end portion thereof for snapping off the second closed end portion inside the container body to allow the liquid to communicate with the first end portion;

the container body is made from a pliant material for allowing the container body to flexibly deform and the tube member is made from a relatively hard material to facilitate breaking-off of the second closed end portion of the tube member at the snap-off score when the container body and the tube member inside the container body are bent about the snap-off score;

and the container body has a top portion defining an aperture for sealingly coupling the tube member and a bottom portion opposite the top portion, the bottom portion having a thickness substantially thinner than that of the top portion of the container body to facilitate bending of the wail of the container body, and the tube member has a portion inside the container body extending to the bottom portion of the container body so that the closed end portion of the tube member is placed adjacent the bottom portion of the container body.

11. A method of dispensing liquid from a container defining a wall, the method comprising the steps of:

sealingly connecting a tube member to the container, the tube member having an open end portion to be placed outside the container and a closed end portion to be placed inside the container;

bringing the wall to come in contact with the tube member inside the container; and applying a force to the tube through the wall to open the closed end portion to allow liquid within the container to communicate with the open end portion of the tube member; and wherein the container has a relatively thick portion for storing substantially an entire volume of the liquid and a relatively thin portion thinner than the thick portion adjacent the closed end portion, the method further comprising the steps of moving substantially the entire volume of the liquid into the relatively thick portion, and removing the closed end portion.

12. A method of dispensing liquid according to claim 11, wherein the wall of the container is made from a pliant material and the tube member has a snap-off score provided adjacent the closed end portion, and wherein the tube member is bent through the wall to snap off the closed end portion at the snap-off score within the container.

* * * * *